United States Patent [19]

Lowson

[11] Patent Number: 4,868,926

[45] Date of Patent: Sep. 26, 1989

[54] ATHLETIC PADS

[75] Inventor: James Lowson, 205 Melrose Ave., Mill Valley, Calif. 94941

[73] Assignee: James owson, Mill Valley, Calif.

[21] Appl. No.: 142,675

[22] Filed: Jan. 11, 1988

[51] Int. Cl.[4] ..... A41D 13/00

[52] U.S. Cl. ..... 2/22

[58] Field of Search ..... 2/22

[56] References Cited

U.S. PATENT DOCUMENTS

| | | | |
|---|---|---|---|
| 1,158,208 | 10/1915 | Hart | 2/22 |
| 1,184,868 | 5/1916 | Pierce | 2/22 |
| 3,877,077 | 4/1975 | Chapdelaine | 2/22 |
| 4,136,226 | 1/1979 | Gilman | 2/414 X |
| 4,674,157 | 6/1987 | Litz | 2/22 X |
| 4,692,946 | 9/1987 | Jurga | 2/22 |
| 4,715,067 | 12/1987 | Beauregard | 2/22 |

FOREIGN PATENT DOCUMENTS

| | | | |
|---|---|---|---|
| 0733239 | 5/1966 | Canada | 2/22 |
| 0971302 | 7/1975 | Canada | 2/22 |

*Primary Examiner*—Werner H. Schroeder

*Assistant Examiner*—D. Biefeld

*Attorney, Agent, or Firm*—McCubbrey, Bartels, Meyer & Ward

[57] ABSTRACT

A protective leg pad for an athletic participant, such as a hockey goalie or the like, is described. The pad includes a thigh section, a knee section, a shin section, and a foot section. Each of the sections includes a front portion and first and second side portions appended to the front portion. Each side portion extends from a respective opposite lateral edge of the front portions and forms therewith a recess for accommodating the wearer's leg. Each of the front and side portions comprises a protective plate. The front portions of the thigh, knee, shin and foot sections are hinged to each other to accommodate the shape and movement of the wearer's leg. The adjacent edges of each adjacent pair of side portions are relieved to provide side relief gaps for enabling flexion of the leg pad during use. Plating is arranged with overlapping portions aligned with the side relief gaps to provide protection over the gaps while permitting the gaps to expand and contract with leg flexure.

14 Claims, 3 Drawing Sheets

ATHLETIC PADS

BACKGROUND OF THE INVENTION

This invention relates generally to the field of protective equipment for participants in athletic activities. More particularly, the invention comprises an improved protective leg pad for use by hockey goalies and the like.

In many athletic activities, there is an inherent risk of injury to the participants in the activity from impact by other players or by objects in use. Thus, equipment is designed to protect players against many types of impacts. In the game of ice hockey, the puck may be shot at the goal tender or "goalie" at speeds in excess of 160 kph. Needless to say, the goalie must wear protective equipment to ward off such impact. Since a goalie uses his legs frequently to block shots, significant protection must be provided, while still permitting maneuverability.

In the game of hockey, protection for the legs of a goalie typically is provided by relatively large protective pads, the size and configuration of which are specified by the rules of the game. Traditionally, hockey goalie pads have been constructed by sewing leather into the form of longitudinal channels and stuffing the channels with deer hair. The deer hair, because it is hollow, provides the required impact resistance and volume with less weight than other stuffing materials. However, the resulting pads are still quite heavy and therefore restrict the goalie's speed and agility.

Foam padding has been used in the prior art for some athletic protection. However, the foam in the prior art has not been successful in goalie pads because of inferior rebound and shock absorbance characteristics as well as a tendency for the foam to break down over a period of use or on exposure to moisture. Moreover, foam pads with sufficient shock absorbance are typically as heavy or heavier than the deer hair pads. In addition, the use of foam in the prior art in place of deer hair in traditional goalie pad designs would result in an excessively rigid pad that would hinder movement of the player.

SUMMARY OF THE INVENTION

It is a principal object of the present invention to provide an improved protective pad for use in athletic activities.

Another object of the present invention is to provide a protective pad which is comfortable, is lightweight, has excellent rebound and shock absorbance characteristics, and is resistant to mechanical degradation over a period of use or by exposure to moisture.

A more specific object of the present invention is to provide a hockey goalie pad which is light in weight while still conforming to the traditional size and configuration of such pads.

The above and other objects of the present invention will become apparent from a reading of the following detailed description with reference to the accompanying drawings which illustrate the preferred embodiment of the present invention.

The present invention takes advantage of foams having improved mechanical characteristics, such as Surlyn (an ionomer resin marketed by E.I. DuPont Nemours and Company) and Softlite TM by Gilman Corporation (an improved form of Surlyn). The protective athletic pad of the present invention includes a thigh section, a knee section, a shin section and a foot section. Each section comprises a front portion, and first and second side portions extending from respective opposite edges of the corresponding front portion. Each section thereby defines a recess to accommodate a corresponding portion of the legs of the goalie. Each of the front and side portions includes a protective plate of a material. such as Softlite TM, of a thickness and an impact absorbance sufficient to provide protection of the legs from injury from impact. Adjacent front and side portions of the athletic pad are movably joined by hinge means arranged to accommodate the shape and movement of the legs. Binding means, preferably with release means, are provided for securing the pad to the legs and for subsequent release of the pad allowing removal from the legs.

DETAILED DESCRIPTION OF THE PREFERRED EMBODIMENT

Figure 1:
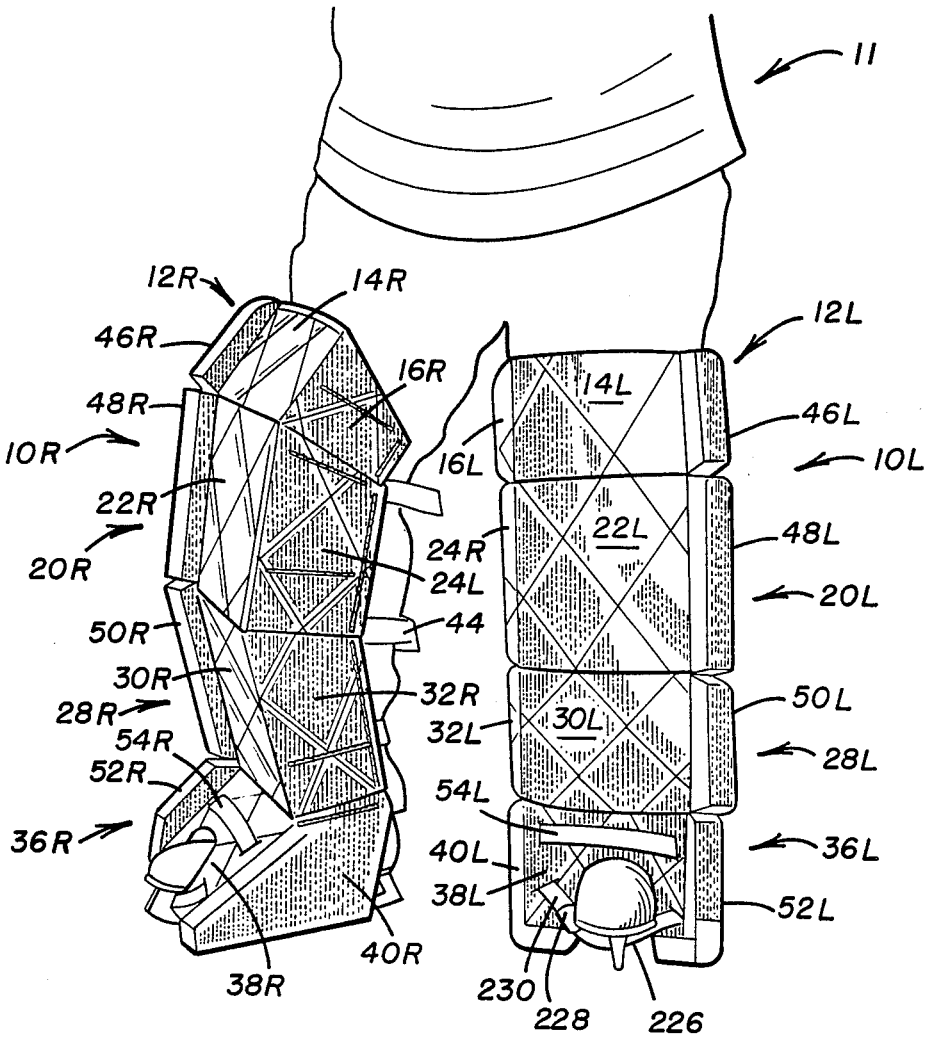
FIG. 1 is a general view of the protective athletic pad of the present invention showing its application to the legs of a hockey goalie.

FIG. 1 is a drawing showing the protective athletic pads of the present invention as applied to the legs of a hockey player. FIG. 1 shows a hockey goalie, generally at 11, whose right leg is slightly flexed and whose left leg is substantially straight. The athletic pads 10R and 10L on the right and left legs of the goalie are mirror images of each other. Each includes a thigh section 12 (L and R) comprising a front portion 14 (L and R) applied to the front of the leg, a first side portion 16 (L and R)applied to the inner side of the leg, and a second side portion 18 (L and R) on the outside of the leg, which is not visible in FIG. 1, but which may be seen in FIGS. 2 and 4. The first side portion 16 (L and R) and the second side portion 18 (L and R) extend from respective opposite edges of the front portion 14 (L and R) to form a recess for accommodating thigh of the leg of the goalie.

Figure 2:
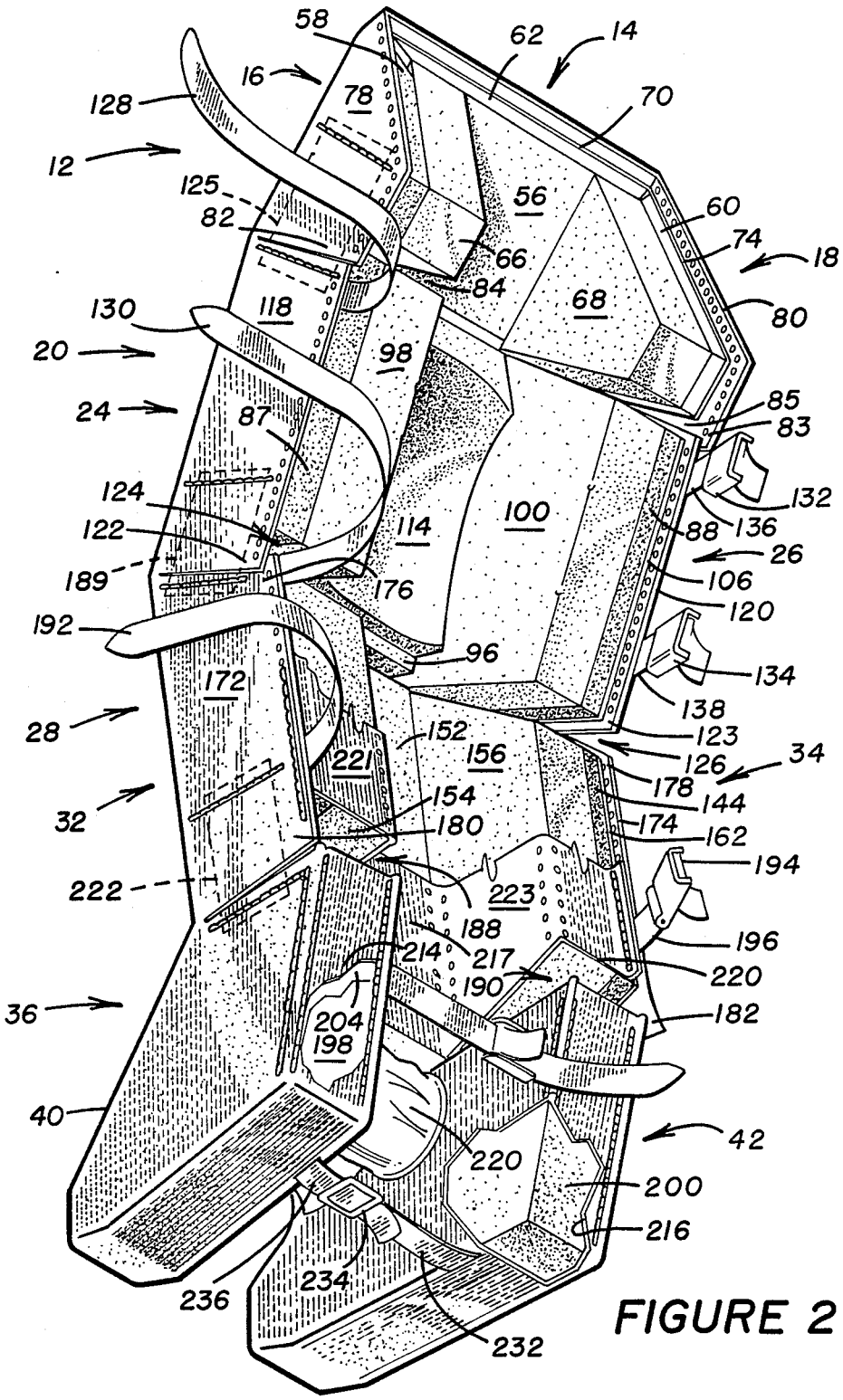
FIG. 2 is an isometric view of the side, back, and interior of the protective athletic pad of the present invention.
Figure 5:
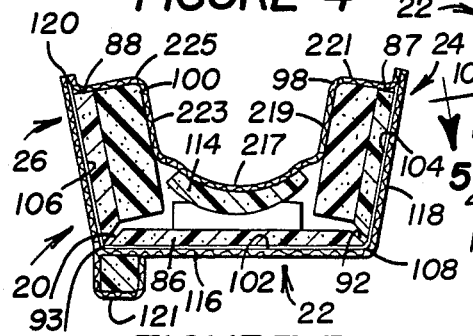
FIG. 5 is a horizontal cross-section through the knee section of the protective athletic pad of the present invention, taken along the line 5—5 of FIG. 3.

The athletic pad 10 also includes a knee section 20 (L and R in FIG. 1) comprising a front portion 22 (L and R), a first side portion 24 (L and R) applied to the inner side of the leg, and a second side portion 26 (L and R) on the outside of the leg, which is not visible in FIG. 1 but which may be seen in FIGS. 2 and 5. As in the construction of thigh section 12, the first side portion 24 (L and R) and the second side portion 26 (L and R) of knee section 20 (L and R) extend from respective opposite edges of the front portion 22 (L and R) to form a recess for accommodating the knee of the goalie.

Figure 6:
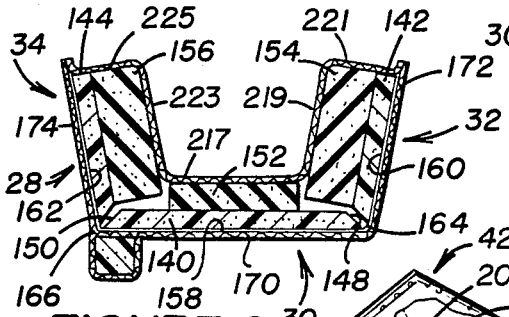
FIG. 6 is a horizontal cross-section through the shin section of the protective athletic pad of the present invention, taken along the line 6—6 of FIG. 3.

As shown in FIG. 1, the athletic pads 10 further includes a shin section 28 (L and R) comprising a front portion 30 (L and R), a first side portion 32 (L and R) applied to the inner side of the leg, and a second side portion 34 (L and R), which is not visible in FIG. 1 but which may be seen in FIGS. 2 and 6. As in the construction of the thigh section 12 (L and R) and the knee section 20 (L and R), in the shin section 28 (L and R), the first side portion 32 (L and R) and the second side portion 34 (L and R) extend from respective opposite edges of the front portion 30 (L and R) to form a recess for accommodating the leg of the goalie.

Figure 7:
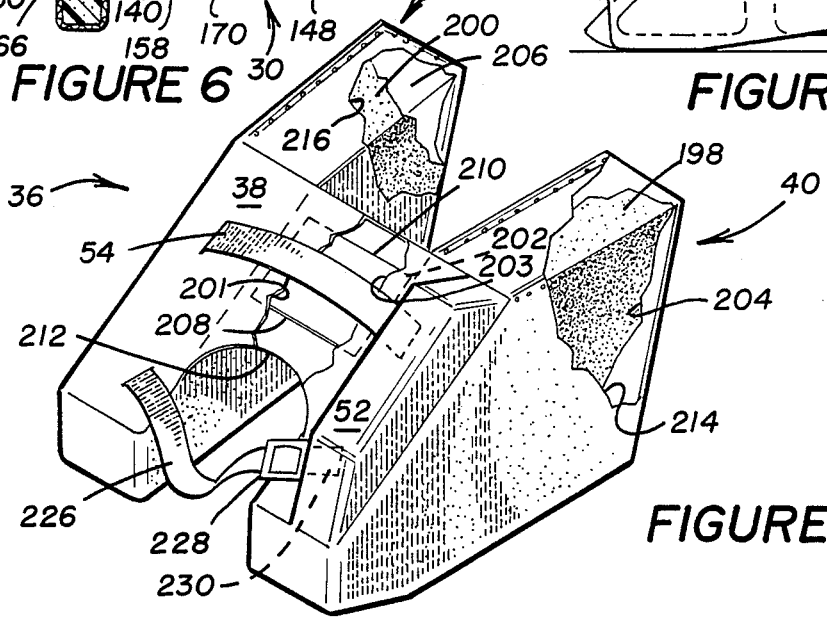
FIG. 7 is a partially cut away isometric view of the foot section of the protective athletic pad of the present invention.

The athletic pad 10 also includes a foot section 36 (L and R) comprising a front section 38 (L and R), a first side portion 40 (L and R) applied to the inner side of the leg, and a second side portion 42 (L and R), which is not visible in FIG. 1 but which may be seen in FIGS. 2 and 7. As in the construction of the thigh section 12 (L and R), the knee section 20 (L and R) and the shin section 28 (L and R), in the foot section 36 (L and R), first side portion 40 (L and R) and the second side portion 4 (L and R) extend from respective opposite edges of the front portion 38 (L and R) to form a recess for accommodating the leg of the goalie. The front portion 38 (L and R) may be constructed to include a semicircular cutout portion to accommodate the toe of the ice skate of the goalie.

As shown in FIG. 1, the athletic pads 10 also include binding means represented generally at 44 for securing the athletic pad to the leg of the goalie. The construction of binding means 44 will be more clearly seen in FIG. 2, as discussed below.

Preferably, the athletic pads 10 also include, in conformity with the traditional configuration of goalie pads and with official hockey rules, a vertical rib or bar extending along the outside edge of each pad. Such a rib may enable the goalie to exercise control over the direction of rebound of a hockey puck after it strikes the athletic pads 10. In the illustrated embodiment, such ribs are found as cheater bars 46 (L and R), 48 (L and R), 50 (L and R) and 52 (L and R) which extend forward from the outside edges of front portions 14 (L and R), 22 (L and R), 30 (L and R) and 38 (L and R), respectively. These are placed on the right edge of the right pad and the left edge of the left pad as show in FIG. 1. Typically, the cheater bars 46 (L and R), 48 (L and R), 50 (L and R) and 52 (L and R) include 1½" square segments of high density, impact-resistant foam, each bar being of a length substantially identical to the one of the front portions 14 (L and R), 22 (L and R), 30 (L and R), or 38 (L and R) from which it extends.

The athletic pad 10 may also advantageously include carrying means 54 (L and R), preferably a strap of nylon or other flexible material attached at each end to the front portion 38 (L and R) of the foot section 36 (L and R). The carrying means 54 (L and R) enables the convenient carrying of the athletic pads 10 when it is not secured by binding means 44 to the leg of the goalie.

The particular structure and function of the elements of the athletic pads 10 indicated above will be described more fully in the discussion below relating to FIGS. 2–7.

Figure 4:
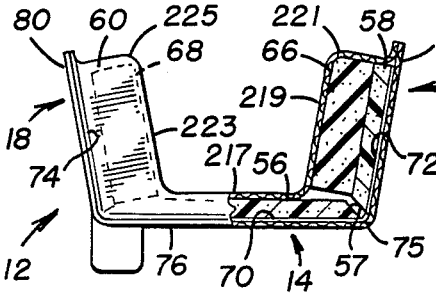
FIG. 4 is a view of the protective athletic pad of the present invention, taken along the line 4—4 of FIG. 3, with part shown in cross-section.
Figure 3:
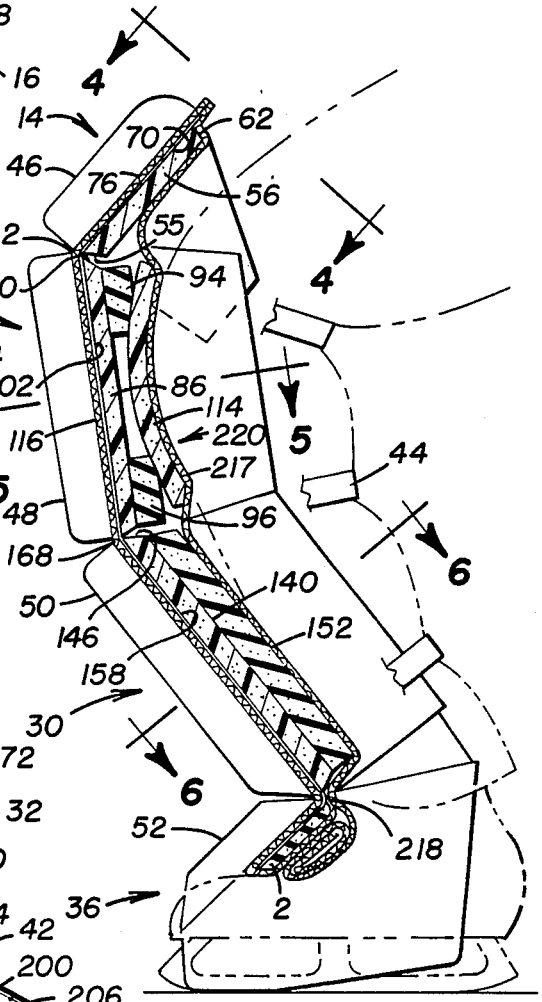
FIG. 3 is a vertical longitudinal cross-sectional view through the center of the front portions of the protective athletic pad of the present invention.

FIG. 2 is an isometric view of the protective athletic pad 10 of the present invention. Thigh section 12, knee section 20, shin section 28, and foot section 36 are of similar general construction. The structure of thigh section 12 is shown in FIGS. 2, 3, and 4. Thigh section 12 includes protective, high density, impact-resistant foam plates 56, 58 and 60 of front portion 14, first side portion 16, and second side portion 18, respectively. Foam plates 56, 58 and 60 are cut to a configuration appropriate to each particular section and in conformity with hockey rules and the traditions of the game.

Generally, foam plate 56 is a one inch thick rectangular plate whose edges which are adjacent other plates of thigh section 12 and of knee section 20 are bevelled inward so as to accommodate hinged movement of adjacent plates relative to each other. The bevelling is more clearly seen in FIG. 3 at 55 and in FIG. 4 at 57. Typically, the dimensions of the outer face of foam plate 56 are 9½" by 5½" and the dimensions of its inner face are 8"×4¾". The top edge 62 of foam plate 56, not being adjacent another plate, need not be bevelled.

Foam plates 58 and 60 of first side portion 16 and second side portion 18, respectively, are of similar construction. Each is generally in the shape of a wedge truncated at its apex and is of the same thickness as foam plate 56. The edges of foam plates 58 and 60 which are adjacent edges of foam plate 56 may be bevelled to accommodate relative hinged movement of the foam plates.

The bottom edges of foam plates 58 and 60 preferably are cut so as to form an acute angle with their respective front edges so as to provide relief gaps to accommodate flexion of the pads 10 during use. Typically, the relief cut of plate 60 on the outer side of the leg forms a more acute angle than does the relief cut of plate 58 on the inner side of the leg. This enables greater flexion of the outer aspect of the athletic pads 10 during, for example, hockey puck blocking maneuvers by the goalie.

The dimensions of the outer face of the foam plate 58 typically are 4½" by 4½" by 3¾" by 2". The dimensions of the outer face of the foam plate 60 are 4" by 4" by 3½" by 1¼". The dimensions of the inner face of the foam plate 58 typically are 4" by 4" by 3¾" by 2". The dimensions of the inner face of the foam plate 60 typically are 3¾" by 3¾" by 3½" by 1¼".

Plates 56, 58 and 60 preferably are formed of a foamed cellular thermoplastic polymeric resin. Such a foam material is described in U.S. Pat. No. 4,136,226 to Gilman, and is an improved form of the DuPont foam material Surlyn. This foam, marketed under the trade name of Softlite TM by Gilman Corporation, is lightweight, strong, and resistant to degradation by moisture, oils, and most chemicals. Preferably, each foam plate comprises a plurality of foam laminations. To achieve improved impact resistance, the foam laminate may be aligned transversely to the alignment of an underlying support sheet, as is more fully and completely described in U.S. Pat. No. 4,137,348 to Gilman. Preferably, the plane of the laminations of the foam is generally horizontal and is normal to the plane of the face of the foam plate thereby formed.

The applicable portions of the Gilman patents cited above which are related directly to the present invention are hereby incorporated by reference. The use of the Gilman foam material in the present invention allows construction of a protective athletic pad that is substantially less than half the weight of comparable protective athletic pads in the prior art made of leather and deer hair. Other advantages of the use of the Gilman foam in the present invention include high tensile and tear strength, high compressive strength, puncture resistance, resistance to low temperature brittleness, and oil and chemical resistance, as well as simplified construction.

In order to increase the protection afforded by the present invention and to increase the comfort of the wearer of the athletic pad, cushion means comprising soft, medium density foam pads 66 and 68 may be attached to the inner faces of protective foam plates 58 and 60, respectively, of thigh section 12. Foam pads 66 and 68 typically are 2" thick and the peripheral dimensions of each are substantially identical to the dimensions of the inner face of the respective protective plates to which it is attached.

Protective foam plates 56, 58, and 60 in the preferred embodiment are covered by outer skin portions 70, 72, and 74, respectively, of a high density, relatively moisture-impervious foam layer integrally formed on the outer surface of foam plates 56, 58 and 60. Such an outer skin is more fully described in U.S. Pat. No. 4,136,226 to Gilman. Outer skin portions 70, 72, and 74 increase structural rigidity, impact resistance, and protection from moisture or chemical degradation for foam plates 56, 58 and 60.

Preferably, outer skin portions 70, 72 and 74 are formed as a continuous sheet fused to the less dense underlying laminated foam during fabrication of Softlite TM. By forming protective plates 56, 58, and 60 from the Softlite TM sheet by cutting through only the thickness of the laminated foam and leaving the outer skin portions 70, 72, and 74 continuous between plates, the plates remain flexibly interconnected. Thus hinge means, represented generally in FIG. 3 at 75, between front portion 14 and each of side portions 16 and 18 is formed.

The surface integrity of foam plates 56, 58 and 60 may be protected further from tearing, abrasion, or puncture by the application of an outer plating comprising outer plates 76, 78, and 80 to the outer surface of protective plates 56, 58 and 60, respectively. Outer plates 76, 78 and 80 may be made, for example, of Cordura nylon, a substantially imperforate material manufactured and marketed by E.I. Dupont de Nemours and Co. The nylon material preferably contains thin, rigid foam insert plates for additional impact resistance. Outer plates 76, 78, and 80 preferably are laced through holes to protective foam plates 56, 58, and 60, respectively. The outer plate 76 may also include a longitudinal pocket, substantially the length of the thigh section 12 from top to bottom, for attaching the cheater bar 46 to the front portion 14 of the thigh section 12.

The peripheral dimensions of the outer plate 76 are substantially identical to the peripheral dimensions of the protective foam plate 56. The peripheral dimensions of the outer plates 78 and 80 are substantially identical to those of the protective foam plates 58 and 60, respectively, except that the outer plates 78 and 80 extend approximately 1"–1½" beyond the bottom edges and the edges of the truncated ends of the wedges of the protective foam plates 58 and 60. The resulting excess outer plating slidably overlaps the adjacent edges of the first side portion 24 and the second side portion 26 of the knee section 20, as shown in FIG. 2 at 82 and 83, respectively. This overlap protects the leg of the goalie from impact injuries from a hockey puck passing through the gap 84 or the gap 85 between protective plates 58 or 60, respectively, and the adjacent side portion 24 or 26 of knee section 20 when the goalie is in the standing position.

The structure of the knee section 20 is shown in FIGS. 2, 3 and 5. The knee section 20 includes protective, high density, impact-resistant foam plates 86, 87 and 88 of the front portion 22, the first side portion 24, and the second side portion 26, respectively. The foam plates 86, 87, and 88 are cut to a configuration appropriate to each particular section.

Generally, the foam plate 86 is a one inch thick square of Softlite TM whose edges are bevelled inward, as shown at 90 in FIG. 3 and at 92 and 93 in FIG. 5 to accommodate movement relative to adjacent plates. Typically, the dimensions of the outer face of the foam plate 86 are 9½" by 9½" and the dimensions of its inner face are 8½" by 8 ½".

The foam plates 87 and 88 of the first side portion 24 and the second side portion 26 of the knee section 20 are of similar construction. Generally, each is a one inch thick plate of laminated Softlite TM and is, in side view, trapezoidal in shape, the front or leading edge being parallel to, but longer than, the rearward edge. The edge of each of the foam plates 87 and 88 adjacent to the foam plate 86 preferably is bevelled to accommodate relative hinged movement of those plates.

The upper edges of the foam plates 87 and 88 preferably are cut to form an acute angle with their respective front edges to provide relief gaps to accommodate flexion of the pads 10 during use. Typically the relief cut of plate 88 and the outer side of the leg forms a more acute angle than does the relief cut of plate 87 on the inner side of the leg. This enables greater flexion of the outer aspect of the athletic pads 10 during, for example, hockey puck blocking maneuvers by the goalie.

Typically the dimension of the outer face of foam plate 87 are 9½" by 4¼" by 7" by 5" and the dimensions of its inner face are 9½" by 4" by 7" by 4¾'. The dimensions of the outer face of foam plate 88 are approximately 9½" by 4" by 6½" by 4¼" and the dimensions of its inner face are 9½" by 3 ¾" by 6½" by 4".

In order to increase wearer protection and comfort, cushion means comprising soft, medium density foam pads 94 and 96 may be applied to the inner faces of the foam plate 86 and the foam pads 98 and 100 may be applied to the inner faces of the foam plates 87 and 88 respectively. Typically, the foam pads 94 and 96 are 1" thick and the pads 98 and 100 are 2" thick. The peripheral dimensions of each of the pads 98 and 100 are substantially identical to the dimensions of the inner face of the respective protective foam plates to which each is attached. The peripheral dimensions of each of the pads 94 and 96 are typically 4½" by 2" and they are attached to the top region and to the bottom region, respectively, of the inner surface of the foam plate 86.

The protective foam plates 86, 87, and 88 preferably are covered by outer skin portions 102, 104, and 106, respectively, of a thin, high density, relatively moisture-impervious foam layer integrally formed on the outer surface of the foam plates 86, 87, and 88. Such an outer skin is more fully described in U.S. Pat. No. 4,136,226 to Gilman. Outer skin portions 102, 104 and 106 increase structural rigidity, impact resistance, and protection from moisture or chemical degradation for the foam plates 86, 87 and 88 respectively.

Preferably, outer skin portions 102, 104, and 106 are formed as a continuous sheet fused to the less dense underlying laminated foam during fabrication of Softlite TM. By forming the protective plates 86, 87 and 88 from the Softlite TM sheet by cutting through only the thickness of the laminated foam and leaving the outer skin continuous between the plates, plates 86, 87, and 88 remain flexibly interconnected. Thus, side hinge means 108 and 110 are formed between the front portion 22 and each of the side portions 24 and 26, 35 respectively.

Preferably, the Softlite TM sheet used to fabricate the foam plate 56 of the front portion 14 of the thigh section 12 is also used to fabricate the foam plate 86 of the front portion 22 of the knee section 20. By doing, so, the outer skin portion 70 and the outer skin portion 102 are continuous, thereby forming front hinge means 112 for flexibly joining the front portion 14 of thigh section 12 and the front portion 22 of knee section 20. Hinge means 112 is shown in FIG. 3.

The protective athletic pad 10 may further include knee guard means 114 fixed to the inner surface of the foam pads 94 and 96 which are fixed to the inner face of the plate 86 of the knee section 20. The knee guard means 114 may be constructed of the same high density, rigid foam material as the knee section 20 and typically is 4½" wide by 8½" long. The inner surface of the knee guard means 114 may be contoured to approximate the knee area of the leg of the goalie in order to increase protection of the knee area and to increase the comfort afforded the wearer.

The surface integrity of foam plates 86, 87 and 88 may be protected further from tearing, abrasion, or puncture by the application of an outer plating comprising outer plates 116, 118, and 120 to the outer surface of the protective plates 86, 87 and 88, respectively. Outer plates 116, 118 and 120 may be made, for example, of Cordura nylon, a substantially imperforate material manufactured and marketed by E.I. Dupont de Nemours and Co. The nylon material preferably contains thin, rigid foam insert plates for additional impact resistance. The outer plates 116, 118, and 120 preferably are laced through holes to the protective plates 86, 87, and 88, respectively. The outer plating may also include a longitudinal pocket 121 substantially the length of the knee section 20 from top to bottom, for attaching the cheater bar 48 to the front portion 22 of the knee section 20.

The peripheral dimensions of the outer plate 116 are substantially identical to the peripheral dimensions of the protective plate 86. The peripheral dimensions of the outer plates 118 and 120 are substantially identical to those of the protective plates 87 and 88, respectively, except that the outer plates 118 and 120 extend approximately 1"–1½" beyond the bottom edges and the rearward-directed edges of the protective plates 87 and 88. The resulting excess outer plating slideably overlaps the adjacent edges of the first side portion 32 and the second side portion 34 of the shin section 28, as represented in FIG. 2 at 122 and 123. This overlap protects the leg of the goalie from impact injuries from a hockey puck passing through the gap 124 or the gap 126 between the protective side plates 87 or 88, respectively, and the adjacent side portion 32 or 36 of the shin section 28 when the goalie is in the standing position.

As shown in FIG. 2, knee section 20 may also include elastic gap covering 125 comprising a rectangular sheet of elastic material, approximately 4" by 5", for covering the gap 84, between the side plate 58 of the thigh section 12 and the knee side plate 87. One edge of the elastic gap covering 125 is sewn to the inside surface of the outer plate 78 of the thigh section 12. A second edge of the elastic gap covering 125 is sewn to the inside surface of outer plate 118 of the knee section 20. The elastic gap coverings 125 may also advantageously be used elastically to reduce gap 84 following flexion of the athletic pads 10 at the hinge means 112, so as to maximize protection of the gap area at all times. FIG. 2 does not show the elastic gaps covering between side plate 60 of thigh section 12 and knee side plate 88. That gap covering covers the gap shown at 85 and is of substantially identical construction as gap covering 125. Its positioning is the mirror image of that of gap covering 125.

The protective athletic pads 10 also preferably includes binding means, shown generally at 44 in FIG. 1, for securing the pad to the leg. As shown in FIG. 2, binding means 44 preferably includes, in the knee section 20, a first strap 128 and a second strap 130, each being made of nylon or other material and first release means 132 and second release means 134 adapted for coupling to the straps 128 and 130, respectively. Typically the release means 132 and 134 are clamping buckles known in the art, for enabling securing and removal of the protective pads 10 from the leg of the goalie.

One end of each of the straps 128 and 130 is adapted for insertion into the release means 132 and 134, respectively. A second end of the strap 128 preferably is fixed to the top region of the inner surface of the outer plate 118, typically by sewing. A second end of strap 130 preferably is fixed to the bottom region of the inner surface of the outer plate 118.

One end of each of release means 132 and 134 is adapted for reception and clamping of the straps 128 and 130, respectively. A second end of the release means 132 is connected to a length of strap material 136 similar to the strap 128. The end of the strap material 136 distal to release means 132 preferably is fixed to the top region of the inner surface of the outer plate 120, typically by sewing. A second end of the release means 134 is connected to a length of strap material 138 similar to the strap 130. The end of strap material 138 distal to release means 132 preferably is fixed to the bottom region of the inner surface of the outer plate 120, typically by sewing.

The positioning of the strap 128, the release means 132, and the strap material 136 at the top region of the knee section 20, and the strap 130, the release means 134, and the strap material 136 at the bottom region of the knee section 20 reduces the lateral and rotational movement of athletic pads 10 when they are secured to the leg of the goalie. This prevents unintentional exposure of lateral aspects of the goalie's legs to potential injury from a moving hockey puck.

The structure of the shin section 28 is shown in FIGS. 2, 3 and 6. The shin section 28 includes protective, high density, impact-resistant foam plates 140, 142 and 144 of front portion 30, first side portion 32, and second side portion 34, respectively. Foam plates 140, 142, and 144 are cut to a configuration appropriate to each particular section.

Generally, the foam plate 140 is a one inch thick square of Softlite TM whose edges are bevelled inward, as shown at 146 in FIG. 3 and at 148 and 150 in FIG. 6 to accommodate hinged movement relative to adjacent plates. Typically, the dimensions of the outer face of the foam plate 140 are 9½" by 9½" and the dimensions of its inner face are 8½" by 8½".

The foam plates 142 and 144 of first side portion 32 and second side portion 34 of shin section 28 are of similar construction. Generally, each is a one inch thick plate of laminated Softlite TM and is, in side view, trapezoidal in shape, the front or leading edge being parallel to, but longer than, the rearward edge. The edge of each of the foam plates 142 and 144 adjacent to the foam plate 140 is bevelled to accommodate relative hinged movement of those plates. The top edges of foam plates 142 and 144 are cut so as to form an acute angle with their respective front edges to provide relief gaps to accommodate flexion of the pads 10 during use. The relief cut of plate 144 on the outer side of the leg forms a more acute angle than does the relief cut of plate 142. This enables greater flexion of the outer portions of pads 10 during, for example, hockey puck blocking maneuvers by the goalie. Typically, the dimensions of the outer face of foam plates 142 are approximately 9½" by 4¼" by 7" by 5" and the dimensions of their inner faces are 9½" by 4" by 7" by 4¾". The dimensions of the outer face of foam plate 144 typically are approximately 9½" by 4¼" by 6¾" by 5¼" and the dimensions of its inner face are 9½" by 4" by 6¾" by 3¼".

In order to increase wearer protection and comfort, cushion means comprising soft, medium density foam pad 152 may be applied to the inner face of the foam plate 140 and foam pads 154 and 156 may be applied to the inner faces of the foam plates 142 and 144, respectively. Typically, the foam pad 152 is 1" thick and the pads 154 and 156 are 2" thick. The peripheral dimensions of each of the pads 154 and 156 are substantially identical to the dimensions of the inner face of the respective protective foam plate to which each is attached. The peripheral dimensions of the foam pad 152 typically are 9½" by 4½".

The protective foam plates 140, 142, and 144 preferably are covered by outer skin portions 158, 160, and 162, respectively, of a thin high density, relatively moisture-impervious foam layer integrally formed on the outer surface of the foam plates 140, 142, and 144. Such an outer skin is more fully described in U.S. Pat. No. 4,136,226 to Gilman. The outer skin portions 158, 160 and 162 increase structural rigidity, impact resistance, and protection from moisture or chemical degradation for the foam plates 140, 142 and 144 respectively.

Preferably, the outer skin portions 158, 160, and 162 are formed as a continuous sheet fused to the less dense underlying laminated foam during fabrication of Softlite TM By forming the protective plates 140, 142, and 144 from the Softlite TM sheet by cutting through only the thickness of the laminated foam and leaving the outer skin continuous between the plates, plates 140, 142, and 144 remain flexibly interconnected. Thus, hinge means 164 and 166 are formed between the front portion 30 and each of the side portions 32 and 34, respectively. Preferably, the Softlite TM sheet used to fabricate foam plate 84 of the front portion 22 of the knee section 20 is also used to fabricate the foam plate 140 of the front portion 30 of the shin section 28. By doing, so, the outer skin portion 102 and outer skin portion 158 are continuous, thereby forming front hinge means 168 for flexibly joining the front portion 22 of the knee section 20 and the front portion 30 of the shin section 28. Hinge means 168 is shown in FIG. 3.

The surface integrity of the foam plates 140, 142 and 144 of the shin section 20 may be protected further from tearing, abrasion, or puncture by the application of an outer plating comprising outer plates 170, 172, and 174 to the outer surface of protective foam plates 140, 142 and 146, respectively. Outer plates 170, 172 and 174 may be made, for example, of Cordura nylon, a substantially imperforate material manufactured and marketed by E.I. Dupont de Nemours and Co. The nylon material preferably contains thin, rigid foam insert plates for additional impact resistance. Outer plates 170, 172, and 174 preferably are laced through holes to the protective foam plates 140, 142, and 144, respectively. The outer plating may also include a longitudinal pocket for attaching the cheater bar 50 to the shin section 28.

The peripheral dimensions of outer plate 170 substantially identical to those of the protective plate 140. The peripheral configuration of each of the outer plates 172 and 174 is substantially identical to those of the protective foam plates 142 and 144, respectively, but the peripheral dimensions of outer plates 172 and 174 are slightly larger. The outer plates 172 and 174 extend approximately 1"-1½" beyond the top, bottom, and rearward-directed edges of the protective plates 142 and 144. The resulting excess outer plating slideably overlaps the adjacent edges of the first side portion 24 and the second side portion 26 of the knee section 20, as represented in FIG. 2 at 176 and 178. The resulting excess outer covering of the shin section 28 also slideably overlaps the adjacent edges of the first side portion 40 and the second side portion 42 of the foot section 36, as shown in FIG. 2 at 180 and 182. This overlap protects the leg of the goalie from impact injuries from a hockey puck passing through the gaps, shown in FIG. 2 at 124 and 126, between the protective foam plates 142 or 144, respectively, and the adjacent foam plates 87 or 88 of knee section 20 when the goalie is in the standing position. The overlap also protects the leg of the goalie from impact injuries from a hockey puck passing through the gaps, shown in FIG. 2 at 188 and 190 between the protective foam plates 142 and 144, respectively, and the adjacent side portions 40 and 42 of the foot section 36.

The shin section 28 may also include an elastic gap covering 189, comprising a rectangular sheet of elastic material, approximately 4" by 5", for covering the gap 124 between the side plate 142 of the shin section 28 and the knee side plate 87. One edge of the elastic gap covering 189 is sewn to the inside surface of side plate outer plate 118 of knee section 20. A second edge of the elastic gap covering 189 is sewn to the inside surface of outer plate 172 of shin section 28. The elastic gap covering 189 may also advantageously be used elastically to reduce the gap 124 following flexion of athletic pad 10 at hinge means 168, so as to maximize protection of the gap area at all times.

FIG. 2 does not show the elastic gap covering between side plate 88 of knee section 20 and side plate 144 covering gap 126. That gap covering is of substantially identical construction as gap covering 189. Its position is the mirror image of that of gap covering 189.

The shin section 28 of protective athletic pad 10 also preferably includes binding means, shown generally in FIG. 1 at 44, for securing the pad to the leg of the goalie. As shown in FIG. 2, binding means 44 of shin section 28 preferably includes a strap 192 made of nylon or other material and release means 194, which typically is a clamping buckle known in the art, for enabling securing and removal of protective pads 10 from the leg of the goalie.

One end of the strap 192 is adapted for insertion into release means 194. A second end of the strap 192 preferably is fixed to the inner surface of outer plate 172, typically by sewing thereto.

One end of release means 194 is adapted for reception and clamping of the strap 192. A second end of release means 194 is connected to a length of strap material 196 similar to strap 192. The end of strap material 196 distal to release means 194 preferably is fixed to the inner surface of outer plate 174, typically by sewing thereto.

Although the position of binding means 44 in the shin section 28 is shown in FIG. 2 approximately midway between the top edges and bottom edges of the plates 172 and 174, the position may be altered within the scope of the present invention. Binding means 44 of the shin section 28 reduces lateral and rotational movement of athletic pads 10 when it is secured to the leg of the goalie. This prevents unintentional exposure of the lateral aspects of the goalie's legs to potential injury from a moving hockey puck The structure of the foot section 36 of athletic pad 10 is shown in FIGS. 2, 3 and 7. The foot section 36 of the preferred embodiment includes a first foot side plate 198, a second foot side plate 200, a front portion 38 comprising an upper pocket part 201 and a lower pocket part 203, the pocket parts being made of a material such as Cordura nylon and disposed adjacent each other to form a pocket, and an arch guard plate 202 sewn within the front portion 38 pocket parts 201 and 203 for protecting the sides and top of the goalie's foot from impact injury Foot plates 198, 200, and 202 are made of protective, high density, 20 impact resistant foam, such as the laminated Softlite TM described above.

Generally, foot side plates 198 and 200 are three inch thick plates of Softlite TM. which, in isometric view as shown in FIG. 2, approximate the shape of a wedge truncated at its apex. Typically, the peripheral dimensions of the each of foot side plates 198 and 200 are 6" (heel) by 8½" (sole) by 2" (toe height) by 11" (top). Arch guard plate 202 generally is a 1" thick rectangular plate of Softlite TM having peripheral dimensions approximately 3" by 4".

The protective foam foot plates 198, 200, and 202 preferably are covered by outer skin portions 204, 206, and 208, respectively, which are made of thin, high density, relatively moisture-impervious foam layers integrally formed on the outer surfaces of the foam plates 198, 200, and 202. Such an outer skin is more fully described in U.S. Pat. No. 4,136,226 to Gilman. The outer skin portions 204, 206 and 208 increase structural rigidity, impact resistance, and protection from moisture or chemical degradation for the foam plates 198, 200 and 202 respectively.

Preferably, arch guard plate 202 is inserted into arch guard plate outer covering envelope 210 which is formed by sewing together the periphery of a rectangular area of pocket parts 201 and 203, shown in FIG. 7, which is sewn to enclose plate 202. Envelope 210 may be advantageously made from a tear, abrasion, and puncture resistant material such as Cordura nylon, a substantially imperforate material manufactured and marketed by E.I. Dupont de Nemours and Co. As shown in FIG. 7, envelope 210 generally is a rectangle of approximately 3¾" width by 3½" length. A semicircular area 212 of approximately 3" diameter is removed from the pocket parts 201 and 203 of foot front portion 38 for accommodating the toe of the goalie's ice skate.

Foot side plates 198 and 200 are enclosed in a first foot side plate outer covering 214 and a second foot side plate outer covering 216, respectively. Coverings 214 and 216 preferably are made of Cordura nylon and need not include foam plate inserts as in the cover plates of the other sections of pads 10 because the function of the outer coverings 214 and 216 is to enclose the foam plates 198 and 200, respectively, rather than to form an additional protective layer to prevent injury to the goalie's leg.

The peripheral edges of foot front portion 38 envelope 210, except for the edge of the semicircular area 212 which extends between the coverings 214 and 216, are sewn to the periphery of the top portion of coverings 214 and 216. The edge of pocket parts 201 and 203 of foot front portion 38 proximate the ankle area of foot section 36 preferably is sewn to the lower edge of the outer plate 170 of the foam plate 140 of the front portion 30 of the shin section 28. Front hinge means 218 is thereby formed to flexibly join the shin section 28 to foot section 36.

The foot section 36 may also include elastic gap covering 222, comprising a rectangular sheet of elastic material, approximately 4" by 5", for covering the gap 188, between the side plate 142 of the shin section 28 and the foot side plate 198. One edge of the elastic gap covering 222 is sewn to the top outside edge of foot side plate outer covering 214. A second edge of elastic gap covering 222 is sewn to the inside surface of outer covering part 172. Elastic gap covering 222 may also advantageously be used elastically to reduce gap 188 following flexion of the athletic pad 10 at hinge means 218, so as to maximize protection of the gap area at all times.

FIG. 2 does not show the elastic gap covering between the side plate 144 of shin section 28 and the side plate 200 of the foot section 36 covering the gap 186. That gap covering is of substantially identical construction as the gap covering 222. Its position is the mirror image of that of the gap covering 222.

The protective athletic pads 10 may further include the inner liner 220, shown in FIGS. 2, 3, 4, 5 and 6 which is disposed inside the recess of the athletic pads 10 and which is attached to the edge of the lower pocket part 203 of the foot front portion 38 proximate the ankle area of the goalie's foot. The inner liner 220 preferably is made of a roll of material such as nylon, cloth, or other pliable material.

The inner liner 220 is shown in FIG. 2 in a rolled condition that enables access to the interior or back of pads 10 and enables the circulation of air for drawings and the like during storage. The inner liner 220, when extended as shown in FIG. 2 and in cross-section in FIGS. 3–6, lines the front and sides of the recess of the athletic pads 1, thereby containing the elements disposed on the inside of the recess. Inner liner 220 also helps to prevent displacement of the recess elements of pads 10 by movement of the goalie's leg and also increases the comfort of the wearer of the pads 10.

As shown in FIGS. 2 and 4–6, the inner liner 220 preferably includes a center section 217 disposes inside the inner surface of the front portions 14, 22, and 30 of the thigh section 12, the knee section 20, and the shin section 28, respectively, of pads 10. The inner liner center section 217 is continuous from its attachment to lower pocket part 203 of the foot front portion 38 to its top edge which, when the inner liner 220 is extended, is attached to the inner aspect of the top edge of the outer plate 76 of the front portion 14 of the thigh section 12, as shown in FIG. 3.

The inner liner 220 also preferably includes a first side liner section 219, shown in FIGS. 4–6, disposed inside the inner surfaces of the first side portions 16, 24, and 32 of the thigh section 12, the knee section 20, and the shin section 28, respectively, of pads 10. The inner edge of the first side liner section 219 is attached to the adjacent edge of center section 217 and the lower edge of the first side liner 219 may advantageously be connected by an elastic member, not shown in the drawings, to the upper rearward edge of the outer covering 214 of the first foot side plate 198. The first side liner 219 is continuous from its lower edge to its upper edge which, when inner liner 220 is extended, is attached to the inner aspect of the top edge of the outer plate 76 of the front portion 14 of the thigh section 12.

The outer lateral edge of the first side liner 219 preferably is attached along its length to an inner edge of the first edge liner 221, shown in FIGS. 2 and 4–6, which lines the rearward aspect of the first side portions 16, 24, and 32. The lower edge of the first edge liner 221 preferably is connected by an elastic member, not shown in the drawings, to the upper rearward edge of the outer covering 214 of the first side plate 198. The first edge liner 221 is continuous from its lower edge to its upper edge which, when the inner liner 220 is extended, is attached to the inner aspect of the top edge of the outer plate 76 of the front portion 14 of the thigh section 12. The outer lateral edge of the first edge liner 221 is attached to the adjacent outer plates 78, 118, and 172 of first side portions 16, 24, and 32.

The opposite lateral edge of center section 217 of inner liner 220 is attached to the second side section 223 in the same manner and the configuration as the attachment of center section 217 to the first side section 219. The outer lateral edge of the second side section 223 is attached to the second edge liner 225 in the same manner and configuration as the attachment of the first side section 219 to the first edge liner 221. The lower, top, and lateral attachments of the second side section 223 and the second edge liner 225 are analogous to those attachments of the first side section 219 and the first edge liner 221, although disposed on the inner and rearward surfaces of the second side portions 18, 26, and 34 of the thigh section 12, the knee section 20, and the shin section 28, respectively.

As noted above in regard to FIG. 1 and as shown in FIG. 7, the athletic pads 10 may also include carrying means 54 enabling the carrying of the athletic pad 10 when it is not secured to the leg of the goalie. Preferably, carrying means 54 includes a strap of Cordura nylon or the like, attached at each end to the top surface of the upper pocket part 201 of foot front portion 38.

As shown in FIGS. 1,2, and 7, the foot section 36 of the athletic pads 10 preferably includes skate securing means for securing the goalie's skate to the foot section 36 of pads 10. Skate securing means includes a toe strap 226, one end of which is attached to the upper pocket part 201 of the foot front portion 38 over the inclined face of the second foot side portion 42. The other end of toe strap 226 is adapted for insertion into and coupling to a toe buckle 228 which is a buckling device known in the art. The toe buckle 228 is attached to one end of connecting strap 230, the other end of which is fixed to the upper pocket part 201 of foot front portion 38 over the inclined face of first foot side portion 40. Straps 226 and 230 may be made of Cordura nylon. Toe strap 226 is inserted through the blade openings and under the sole of the goalie's skate and thereby secures the toe area of the foot section 36 to the skate.

The skate securing means may also include heel strap 232, heel buckle 234 and heel connecting strap 236. One end of the strap 232 is fixed to the heel portion of the underside of the outer covering 216 of foot side portion 42, the other end being adapted for insertion into and coupling to heel buckle 234 which is a buckling device known in the art. The heel buckle 234 is attached to one end of the connecting strap 230, the other end of which is fixed to the heel portion of the underside of the outer covering 214 of foot side portion 40. Straps 232 and 236 may be made of Cordura nylon. Heel strap 232 is inserted through the blade openings and under the sole of the goalie's skate and thereby secures the heel area of the foot section 36 to the skate.

Preferably the outer plates 76 and 116 are joined at their adjacent edges to form a flexible reinforcement of hinge means 112 between the thigh section 12 and the knee section 20. In a like manner, it is preferable that the outer plates 116 and 170 are joined at their adjacent edges to form a flexible reinforcement of hinge means 168 between knee section 20 and shin section 28. And, in the preferred embodiment, the outer plate 170 and to upper pocket part 201 and the lower pocket part 203 of foot front portion 38 are joined at their adjacent edges to form a flexible reinforcement of hinge means 218 between the shin section 28 and the foot section 36.

The present invention, therefore enables advantageous use of foam materials, such as that described in U.S. Pat. No. 4,136,226 to Gilman, in protection equipment for participants in athletic activities such as hockey playing. The teaching of the present invention of plates of foam material, rather than deer hair stuffed into multiple leather channels, simplifies construction of protective athletic pads while enabling freedom of movement of the wearer of the pads. The present invention provides an improved protective pad which is comfortable, lightweight, and has excellent rebound and shock absorbance characteristics, and is resistant to mechanical degradation over a period of use or by exposure to moisture. The pad of the present invention conforms to the traditional size and configuration of goalie pads. Although the preferred embodiment of the present invention has been described and illustrated above, particularly with respect to ice hockey, it will be apparent that numerous alterations, additions, or deletions of elements of the apparatus may be undertaken without departing from the spirit of the present invention, for example to adapt the pads to other sports such as lacrosse, field hockey, cricket, and the like. Thus the invention is delimited only by the following claims.

I claim:

1. A protective leg pad for an athletic participant, such as a hockey goalie or the like, comprising:

a thigh section, a knee section, a shin section, and a foot section, each of said sections including a front portion and first and second side portions appended to said front portion, said side portions of each of said sections being attached to and extending from respective opposite lateral edges of said front portion and forming therewith a recess for accommodating a corresponding portion of a human leg, each of said front and side portions comprising a protective plate of a material having a thickness and impact absorbance enabling protection of said corresponding portion of a human leg from injury from impact by a moving object, such as a hockey puck or the like;

front hinge means for flexibly joining adjacent front portions of said thigh, knee, shin, and foot sections in stated order, said hinge means being arranged to accommodate the shape and movement of the human leg the adjacent edges of each adjacent pair of said side portions being relieved to provide side relief gaps for enabling flexion of said leg pad during use; and plating means having overlapping portions aligned with said side relief gaps to provide protection over said gaps while permitting said gaps to expand and contract with leg flexure.

2. The protective leg pad of claim 1 wherein each of said protective plates includes a high density, relatively moisture-impervious outer skin for increasing structural rigidity, impact-resistance, and protection from moisture.

3. The protective leg pad of claim 2 wherein said outer skin is continuous between adjacent front portions thereby forming said hinge means.

4. The protective leg pad of claim 1 further including binding means for securing said pad to the human leg, said binding means including release means for enabling removal of said pad from the human leg.

5. The protective leg pad of claim 1 wherein each of said protective plates is made of a rigid, impact-resistant, high density foam material.

6. The protective leg pad of claim 1 or claim 5 wherein each of said protective plates includes a laminated foam material.

7. The protective leg pad of claim 6 wherein the plane of said laminations of said foam material is generally horizontal and is normal to the plane of the face of each of said plates.

8. The protective leg pad of claim 1 further including cushion means comprising a plurality of soft, medium density foam pads, each of said foam pads being attached to the inner face of one of said protective plates for cushioning the contact of said plates with the human leg.

9. The protective leg pad of claim 1 wherein said plating means comprise an outer plating of tear-resistant material enclosing a plurality of a planar rigid foam inserts.

10. The protective athletic pad of claim 1 wherein said plating means extends beyond the perimeter of the one of said protective plates to which said plating means is associated and slidably overlaps the adjacent top or bottom edge of said plating means associated with the adjacent one of said portions.

11. The protective leg pad of claim 1 further including knee guard means fixed to the inner surface of said front portion of said knee section, said knee guard means being contoured to approximate the knee area of the human leg for increasing the protection of said knee area and for increasing the comfort to the wearer of said protective leg pad.

12. The protective leg pad of claim 1 further including inner liner means for lining said recess.

13. The protective leg pad of claim 1 wherein said foot section further includes skate securing means for securing the skate of said hockey goalie to said leg pad.

14. The protective leg pad of claim 1 further including elastic gap covering means comprising a plurality of planar segments of elastic material, each of said segments having a top and bottom edge, said top edge being connected to the lower region of said outer covering applied to one of said side portions and said bottom edge being connected to the upper region of said outer covering applied to an adjacent one of said portions.

* * * * *